United States Patent [19]

Blahout

[11] Patent Number: 5,029,784

[45] Date of Patent: Jul. 9, 1991

[54] DISPLAY STAND

[76] Inventor: Michael Blahout, 652 Wavell Avenue, Ottawa, Ontario, Canada, K2A 3B1

[21] Appl. No.: 455,068

[22] Filed: Dec. 22, 1989

[30] Foreign Application Priority Data

Dec. 22, 1988 [CA] Canada ..... 586921

[51] Int. Cl.[5] ..... F16M 11/38

[52] U.S. Cl. ..... 248/166; 248/460; 248/472

[58] Field of Search ..... 248/166, 176, 460, 462, 248/465.1, 469, 472, 441.1, 447; 211/40, 41, 42

[56] References Cited

U.S. PATENT DOCUMENTS

| | | | |
|---|---|---|---|
| 3,376,009 | 4/1968 | Domino | 248/460 X |
| 3,381,928 | 5/1968 | White | 248/460 X |
| 3,958,786 | 5/1976 | Mann | 248/460 X |
| 4,150,807 | 4/1979 | Manso | 248/460 X |
| 4,544,123 | 10/1985 | Peacock | 248/460 |
| 4,886,231 | 12/1989 | Doerksen | 248/460 X |

*Primary Examiner*—Ramon O. Ramirez

*Attorney, Agent, or Firm*—Rogers, Bereskin & Parr

[57] ABSTRACT

A display stand has a base having a front and a rear, and a back support extending up from the rear of the base. Stops are provided at the front of the base. Means are provided for bracing the base and the back, in conjunction with an object, to form a stable triangulated structure. The bracing comprises a frictional finish on the stand for gripping an object and a horizontal support surface, with resilient stiffening elements between the base and the back and between the stops and the base.

10 Claims, 3 Drawing Sheets

DISPLAY STAND

This invention relates to a collapsible display stand for displaying objects, such as books or plates.

There are a variety of known display stands. It is common for such collapsible display stands to be rigid planar surfaces connected together or tubular structures clamped together. A common element to both the planar and tubular designs is the structural integrity of the stand. In this regard the stands are rigid structures that are structurally self-sufficient on which a book, for example, can be propped. The stands can then be folded up or dismantled to save space or to allow for easy transport.

Stands of this type are, however, inefficient. Since the stands have to be structurally self-supporting they are relatively bulky and heavy. Many of them are complex and would be expensive to manufacture. Even when collapsed they take up a significant amount of space. Many such stands take considerable time to assemble and disassemble.

In accordance with the present invention, there is provided a display stand, for objects, comprising:

(a) a base having a front and a rear;

(b) retaining means at the front of the base for retaining a lower edge of an object;

(c) a back support having lower and upper ends, pivotally connected to the rear of the base at the lower end of the back support, the upper end of the back support being adapted to abut and support an object above the lower edge of an object;

(d) bracing means for forming, in an open configuration, a stable triangulated structure between the base, the back support, and an object and for preventing relative movement between the base, the back support, the retaining means, and an object, the bracing means also permitting the display stand to be collapsed into a compact closed configuration.

The stand of the present invention allows for quick and simple collapsing and setting up of the display stand. This is accomplished by making the object to be displayed an integral part of the structure of the display stand. A feature of the invention is that elements of the stand are pivotally connected in such a way that no clamping is required to prevent relative rotation between them. The pivotal connections are sufficiently resilient that they can be bent by hand; yet with a book or other object present, they will retain whatever angle they are positioned in. The bracing means ensures that, with a book or other object, a stable structure is formed, and can comprise a frictional finish on the outside of the stand and stiffening elements for pivot connections. The degree of bracing provided by these two features can be varied. Thus, with extremely stiff stiffening elements, a high gloss or low friction finish may be acceptable at least for some uses. On the other hand, with a very high friction finish, it is conceivable that, against at least for some uses, a simple pivot connection or hinge could be provided between the back and the base.

Thus, the bracing means enables the object to form part of the structure. This in turn enables the stand itself to be simple and lightweight. As a consequence, in the collapsed or folded configuration, it is extremely lightweight and compact. It can then readily be carried in a briefcase or handbag, for example.

For a better understanding of the present invention and to show how it may be carried into effect, reference will now be made, by way of example, to the accompanying drawings, in which.

Figure 1:
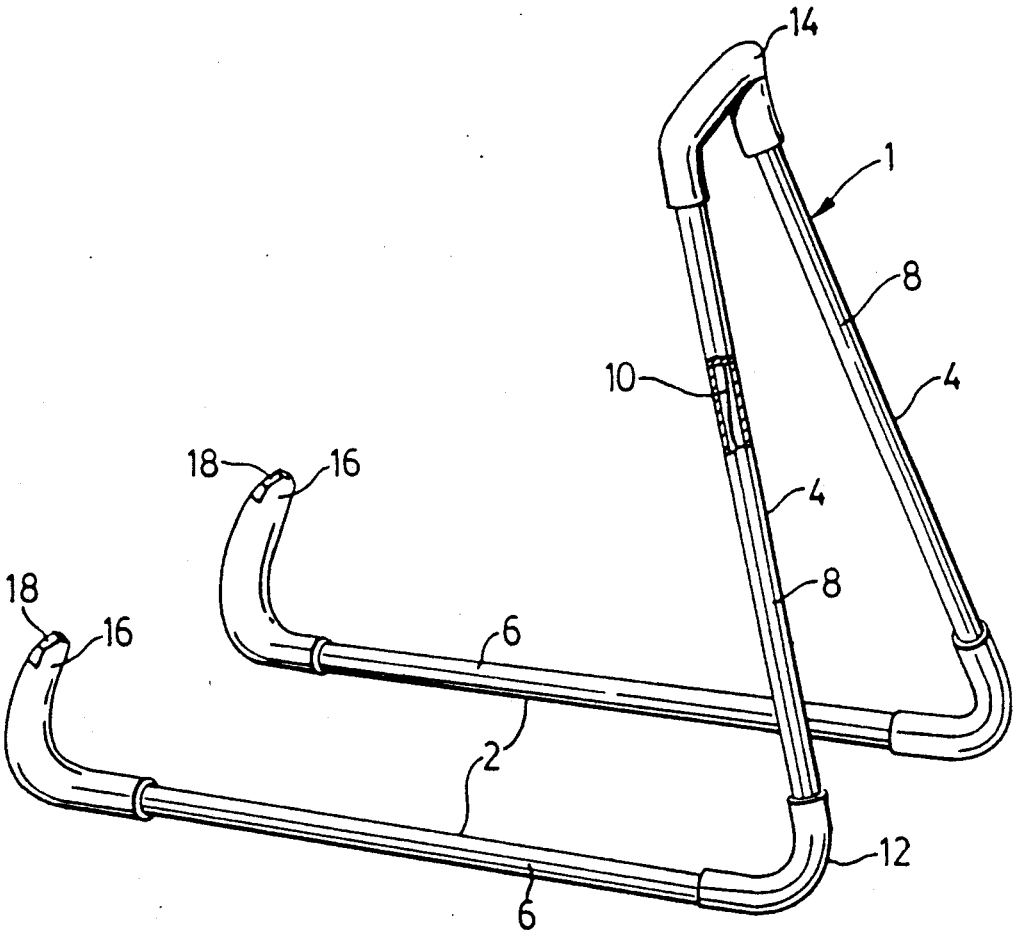
FIG. 1 is a perspective view from above of one embodiment of a display stand according to the present invention in an open configuration.
Figure 2:
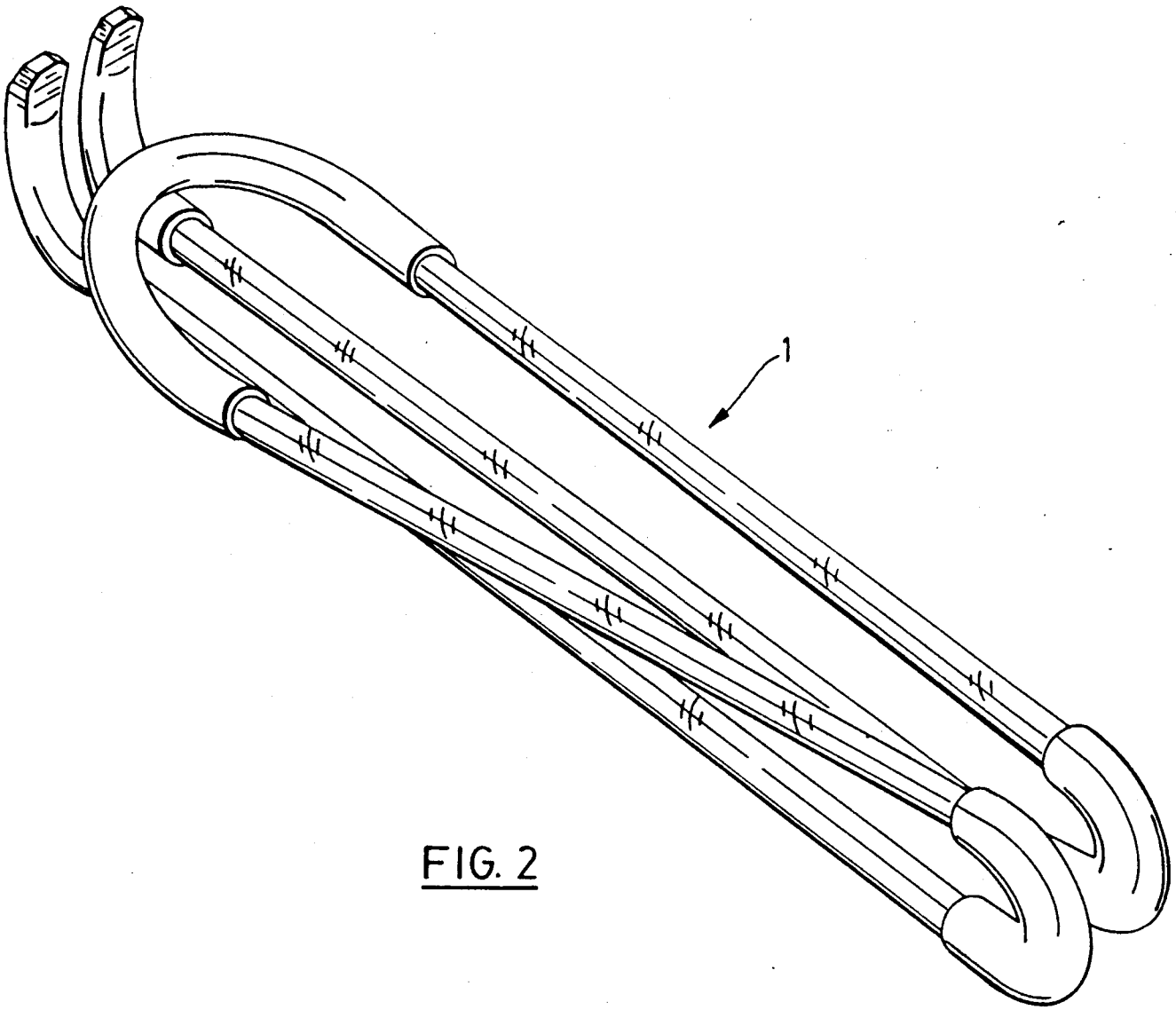
FIG. 2 is a perspective view of the display stand of FIG. 1 in a closed configuration.

Reference will first be made to FIGS. 1 and 2 which show a first version of the collapsible display stand. The collapsible display stand it generally designated by the reference 1, and comprises a base 2 and a back 4.

The base 2 comprises a pair of base bars 6, whilst the back 4 comprises a similar pair of back bars 8. Each of the bars 6, 8 is in the form of a hollow tube, as shown in the cutaway section of one of the bars 8.

Extending throughout the hollow bars 6, 8 is an elongate stiffening member 10. The stiffening member 10 is in the form of a metal wire having a significantly smaller diameter than the interior diameter of the bars 6, 8. As a consequence, as described in greater detail below, it effectively floats within the hollow bars 6, 8.

The ends of the hollow bars 6, 8 are joined by flexible hollow tubular elements 12, each of which comprises a short, rubber tube. The rubber tubes are so dimensioned as to form a tight fit on the hollow bars 6, 8. A similar hollow tubular element 14 extends between the upper ends of the back bars 8.

At the front of the base bars 6, there are two further hollow tubular elements 16, and again one end of each element 16 forms a tight fit on the respective base bar 6. The other ends of the tubular elements 16 are flattened, sealed and trimmed, as indicated at 18.

The elongate stiffening member 10 extends from close to the ends 18 through the tubular elements 12, 14 in addition to the hollow bars 6, 8. As shown in FIG. 1, the ends of the stiffening member 10 hold the ends 18 of the tubular elements 16 upright so as to form stops for an object, as detailed below. These stops thus form a retaining means for retaining an objection on the display stand.

Additionally, the outside of the tubular elements 12, 14, 16 is given a frictional finish, e.g. by coating them with a resilient rubbery compound, if the original tubular element does not have a sufficient finish.

Then, the stiffening provided by the elongate stiffening member 10, together with the frictional finish on the tubular elements 16, 18 should provide sufficient bracing for the displaying stand.

In FIG. 1, the display stand 1 is shown in an open configuration, whilst in FIG. 2 it is shown in a collapsed configuration. The manner in which the display stand supports a book is described in greater detail below in relation to FIG. 3.

Figure 3:
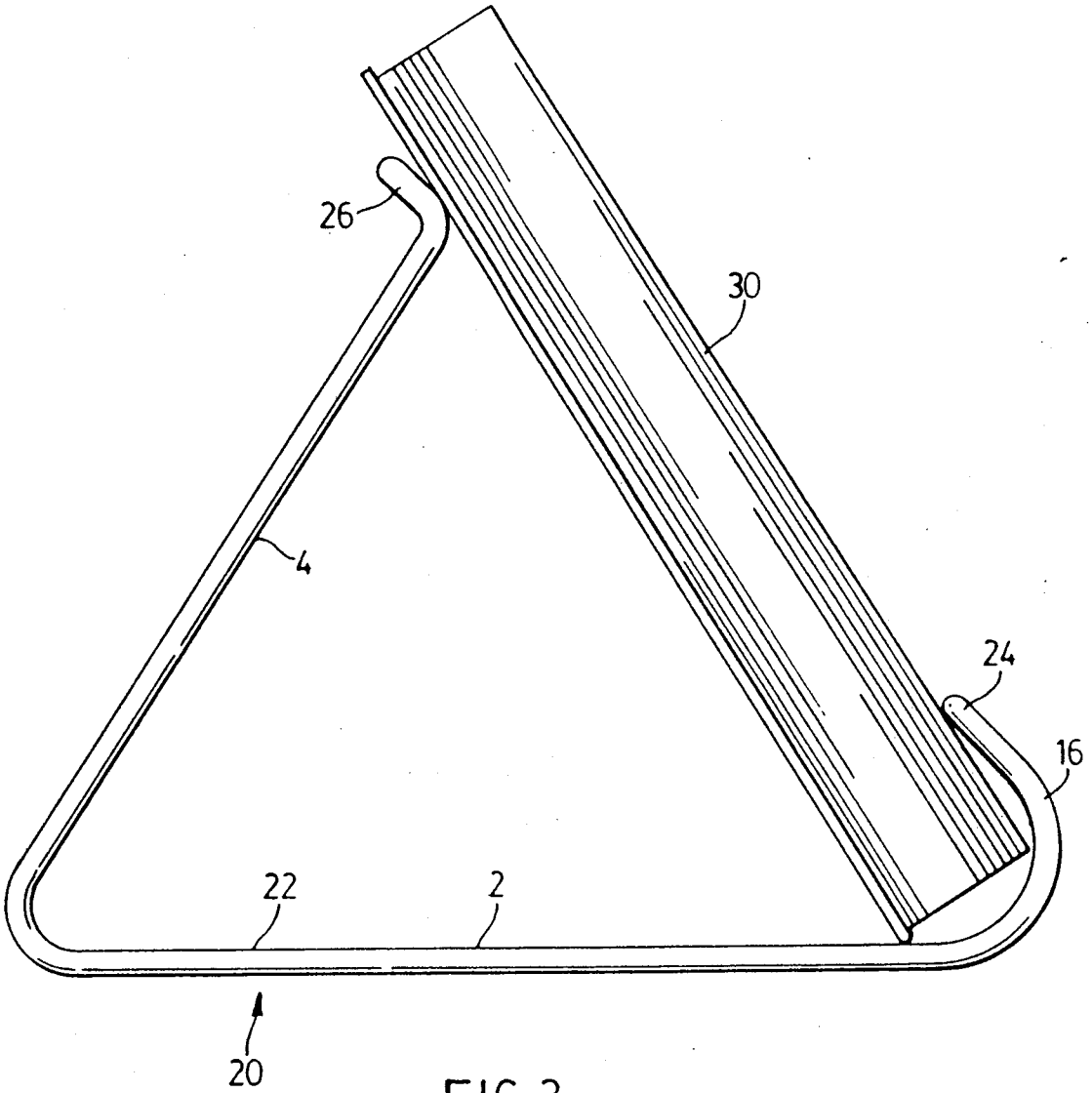
FIG. 3 is a side view of a display stand according to a variant embodiment of the invention, supporting a book.

Whilst in FIG. 1, separate and discrete tubular elements 12, 14 and 16 are used, it is envisaged that a continuous tubular covering could be provided for the display stand. This is shown in FIG. 3. Here, the display stand is generally indicated by the reference 20. Although not shown in FIG. 3, is would include back and base bars 6, 8 and the elongate stiffening member 10, freely floating within the bars 6, 8. Now, a continuous tubular member 22 is provided having ends 24. The tubular member 22 encases the stiffening member 10 as well as the hollow tubes 6, 8. At the top of the back 4, the stiffening member 10 is bent upwardly and rearwardly to form a back support portion 26. This second embodiment of FIG. 3 functions similarly to that of FIG. 1 and 2. One reason for providing a continuous tubular covering 22 is to provide a smooother and more attractive finish to the display stand.

In use, the display stand 1 or 20 is manipulated to the open configuration shown in FIGS. 1 and 3. In this position, a book 30 or other object, e.g. a plate, would be placed on the stand. The top of the book 30 is supported on the back support 24. The lower edge of the book 30 is engaged by the tubular elements or stops 16.

This forms a stable triangulated structure, in which the stiffening element 10 and the frictional finish maintains the structure stable. Thus, the stops 16 are prevented from deflecting under the load imposed by the book 30, by the stiffness of the stiffening element 10. The frictional finish on the base bars 6 an elongate tubular covering 22 maintain the base bars 6 in position on the horizontal surface on which the stand is placed. This is also assisted by the stiffness of the stiffening element 10.

The angle of the back 4 is maintained by both the stiffness of the stiffening element 10 an also by the friction between the back support 24 and the back face of the book 30. Finally, the stiffness of the stiffening element within the back support 24 helps to hold the angle between the back bars 8.

Because of this interaction of the various elements, the display stand 1 can be exceedingly compact and lightweight, yet capable of supporting a relatively large load, e.g. quite a large book. At the same time, it is readily collapsible. The elongate stiffening member 10 is so dimensioned that it can be readily collapsed by hand. Thus, the back bars 8 are pressed together until they are substantially parallel. Similarly, the base bars 6 are pressed together until they are parallel and adjacent to one another. The back bars 8 are then pressed towards the base bars 6, to bring them into the general configuration shown in FIG. 2. If desired, to hold the device in this configuration, the stops 16 can be folded over the flexible tubular element 14. The display stand is then in an exceedingly compact configuration, and can readily be carried in a handbag, briefcase etc.

The display stand and individual components thereof can be dimensioned for any particular intended use.

The embodiments of the invention in which an exclusive property or privilege is claimed are defined as follows:

1. A display stand, for objects, comprising:

(a) a base having a front and a rear;

(b) retaining means at the front of the base for retaining a lower edge of an object;

(c) a back support having lower and upper ends, pivotally connected to the rear of the base at the lower end of the back support, the upper end of the back support being adapted to abut and support an object above the lower edge of an object; (d) bracing means for forming, in an open configuration, a stable triangulated structure between the base, the back support, and an object and for preventing relative movement between the base, the back support, the retaining means, and an object, the bracing means also permitting the display stand to be collapsed into a compact closed configuration;

the retaining means including a pair of stops moveable between a closed position and an open position extending upwardly from the base to abut the lower edge of an object;

the bracing means including stiffening elements between the stops and the base, and between the base and the back, the stiffening elements being sufficiently stiff to prevent relative rotation between the stops, the base, and the back in the open configuration while being sufficiently resilient to enable the display stand to be manually bent between the open and closed configurations;

the base including two rigid base bars with each stop of the retaining means being connected by a stiffening element to the front of a respective base bar; and, the back support including two rigid back bars each of which at a lower end thereof is connected to a respective base bar at the rear thereof by a stiffening element, the back bars being connected to each other by a further stiffening element at their upper ends which form the upper end of the back support.

2. A display stand as claimed in claim 1 wherein the bracing means includes a frictional finish on the stiffening elements and the upper end of the back support.

3. A display stand as claimed in claim 1 wherein the back and base bars are tubular, the stiffening elements comprise a continuous elongate stiffening member extending through the base and back bars, and the display stand includes flexible tubular elements each of which extends between adjacent ends of the back and base bars, so that the stiffening member is encased by the flexible tubular elements and the back and base bars.

4. A display stand as claimed in claim 3, wherein, for the retaining means, each stop comprises a free end of the elongate stiffening member and a flexible tubular element covering that free end and mounted on the front end of a respective base bar.

5. A display stand as claimed in claim 3, wherein the elongated stiffening member that extends through the back and base bars and through the flexible tubular elements floats freely within the back and base bars, and the flexible tubular element, in both the open and closed configurations.

6. A display stand as claimed in claim 3, 4 or 5, wherein the flexible tubular elements are incorporated into a continuous elongate flexible tube that encloses the base and back bars and the continuous elongate stiffening member.

7. A display stand as claimed in claim 3, 4 or 5, wherein the bracing means includes a frictional finish on the flexible tubular elements.

8. A display stand as claimed in claim 3 wherein the flexible tubular elements are incorporated into a continuous elongate flexible tube that encloses the back and base bars and the continuous elongate stiffening member, and the bracing means includes a frictional finish on the continuous elongate flexible tube.

9. A display stand as claimed in claim 4 wherein the flexible tubular elements are incorporated into a continuous elongate flexible tube that encloses the back and base bars and the continuous elongate stiffening member, and the bracing means includes a frictional finish on the continuous elongate tube.

10. A display stand as claimed in claim 8 or 9, wherein the continuous elongate stiffening member floats freely within the back and base bars, and the continuous elongate flexible tube, in the open and closed configurations.

* * * * *